US006014881A

United States Patent [19]

Imanari

[11] Patent Number: 6,014,881

[45] Date of Patent: Jan. 18, 2000

[54] ROLLING ROLL PROFILE CONTROL EQUIPMENT

[75] Inventor: Hiroyuki Imanari, Tokyo, Japan

[73] Assignee: Kabushiki Kaisha Toshiba, Kawasaki, Japan

[21] Appl. No.: 09/280,721

[22] Filed: Mar. 30, 1999

[30] Foreign Application Priority Data

Mar. 30, 1998 [JP] Japan ..... 10-084192

[51] Int. Cl.[7] ..... B21B 27/06

[52] U.S. Cl. ..... 72/201

[58] Field of Search ..... 72/200, 201, 236, 72/241.2, 241.4, 241.6, 43

[56] References Cited

U.S. PATENT DOCUMENTS

| | | | |
|---|---|---|---|
| 4,422,318 | 12/1983 | Christ et al. | 72/200 |
| 4,735,073 | 4/1988 | Schrors | 72/200 |
| 4,793,172 | 12/1988 | Eibe | 72/200 |
| 5,799,523 | 11/1998 | Seidel et al. | 72/201 |

FOREIGN PATENT DOCUMENTS

| | | |
|---|---|---|
| 3-275203 | 12/1991 | Japan . |
| 6-015312 | 1/1994 | Japan . |
| 7-303911 | 11/1995 | Japan . |

*Primary Examiner*—Rodney Butler

*Attorney, Agent, or Firm*—Oblon, Spivak, McClelland, Maier & Neustadt, P.C.

[57] ABSTRACT

Controlling the roll diameter distribution across the axial direction of a rolling mill roll. A device to measure or predict the roll diameter of each section, control position by control position, into which the roll is divided in the axial direction. A temperature management device, provided at every section into which the roll is divided, and includes a cooling device that cools the corresponding section or heating device that heats the corresponding section. A roll profile control device control the temperature management device so that the respective measured or predicted roll diameters follow desired values at every section into which the roll is divided.

7 Claims, 9 Drawing Sheets

ROLLING ROLL PROFILE CONTROL EQUIPMENT

BACKGROUND OF THE INVENTION

1. Field of the Invention

The present invention relates to rolling roll profile control equipment that controls the roll profile in the axial direction, that is to say the roll diameter distribution, of a rolling roll in the hot rolling or cold rolling of metal materials.

2. Description of the Related Art

As quality controls in hot thin strip rolling and cold thin strip rolling, there is a strip thickness control, which controls the strip thickness in the central part in the width direction of the strip; a strip width control, which controls the strip width to a set value; and a temperature control, which controls the temperature of the strip to the optimum. In addition, there are such controls as a crown control, which controls the strip thickness distribution in the width direction, that is to say the strip profile; and a flatness control, which controls the distribution of extension in the width direction of the strip.

Of these controls, the crown control and flatness control are the roll bending equipment or roll cross equipment installed at the ends in the width direction of a rolling roll (hereafter referred to as "work roll" or "roll"). Roll bending equipment is the equipment that controls the strip profile by bending the roll. Roll cross equipment is equipment that controls the strip profile by crossing upper and lower rolls in the rolling direction and varying the width direction distribution of the roll gap.

The factors that particularly affect strip profile are the rolling load and roll profile. Of these, the roll profile has a great influence because the rolling roll is in direct contact with the strip.

As causes of variation of the roll profile, there are variations of the thermal crown due to the heat received from the strip (i.e., the roll diameter due to thermal expansion), and wear due to contact between the rolling roll and the strip. FIG. 1 (*a*) shows a roll profile having a thermal crown for the original roll profile. FIG. 1 (*b*) shows a roll profile that combines the two factors of thermal crown and wear.

FIG. 2 shows the variation over time of the roll profile of the cross-section at arrows A—A of a work roll, in a position shifted somewhat sideways from the center of the axial direction, in the case of having rolled one strip. Here, the thermal crown, shown by dotted curve P, gradually grows with the passage of time, and there is a tendency to saturate. Wear, shown by dotted straight line Q, progresses at a roughly constant rate. Consequently, the roll profile varies as in curve R, which is obtained by combining these two. These tendencies occur and variously deform the roll at each cross-section. Therefore, the profile of the roll in the width direction does not always become a simple curve such as shown in FIG. 1 (*a*).

FIGS. 3 (*a*) and (*b*) show conceptual thermal crown growth in cases of continuous rolling. Of these, 3 (*a*) shows the case of a short rolling pitch, and 3 (*b*) that of a long rolling pitch. In each case these are shown by solid lines and dotted lines (the difference between solid lines and dotted lines will be explained below).

In order to control such roll profile variations for wear, such measures as making the roll out of highly wear-resistant material can be taken. Also, as technology for dealing with the thermal crown, for example, the methods reported in the following publications (a), (b) and (c) are known.

(a) There is a method of altering the reduction ratio of the rolling mill to control thermal crown growth, reported in Laid-Open Patent Showa (Tokkoushou) 56—1161 Gazette as "Hot Strip Rolling Method Designed to Rationalise Strip Crown".

(b) There is a method of adjusting the rolling pitch, reported in Laid-Open Patent Showa (Tokkoushou) 60—5370 Gazette as "Thermal Crown Control Method and Equipment for Hot Strip Finish Rolling".

(c) There is a method of adjusting roll cooling water, reported in Laid-Open Patent Showa (Tokkoushou) 60—5731 Gazette as "Control Method for Strip Crown in Hot Strip Finish Rolling".

Of the above-mentioned prior art techniques, with the method reported in (a) there were cases when the reduction ratios of the various stands of the rolling mill could not always correct for thermal crown control. That is to say, the reduction ratio directly affects the rolling state and product quality, such as rolling load, crown, and tension of the relevant stand, and was used preferentially in the control of these. In actuality, the frequency of its use as a means of thermal crown control was low.

Also, with the method reported in (b), the rolling pitch is determined based on production plans, and is almost always determined by operational reasons such as the avoidance of trouble. In actuality it was hardly ever used as a means of thermal crown control.

On the other hand, the method reported in (c) is currently the most widely used. However, even when the roll is cooled, it is difficult to control the thermal expansion of the roll due to differences in conditions such as rolling pitch, strip temperature, and the flow and temperature of cooling water.

Generally, to reduce the effect of roll thermal crown, there are methods of controlling the growth of the thermal crown and, provided that the roll profile is constant, the effects on strip profile and strip thickness will reduce. Also, because the roll emits the absorbed portion of the heat received from the strip, very large amounts of cooling water are required, and it is difficult to install that type of roll cooling equipment.

Also, as shown in FIG. 2, the thermal crown has the property of saturation and, when rolling is performed at a comparatively short pitch, as shown in FIG. 3 (*a*), the effect of the thermal crown variation becomes smaller after saturation.

However, as shown in FIG. 3 (*b*), when the rolling pitch is long, a once-formed thermal crown cools while awaiting rolling, and is likely to return to its original condition before rolling the next strip. In this case, the effect of thermal crown variation on the degree of rolling appears strongly. Furthermore, when the roll temperature is low, the efficiency of heat release from the strip becomes high. This accelerates the temperature drop at the head end of the strip and often has a bad effect on strip thickness accuracy and the like.

Also, in order to measure the roll profile, a special detector was required that detects the roll profile by scanning, either optically or by contact, in the width direction of the roll, even during rolling. On the other hand, because there are limitations such as space for installing this detector, there is also a method of not directly detecting the roll profile but predicting it from other quantities of state (such as, for example, rolling load and rolling speed). However, as mentioned above, roll profile actually has a very complex behavior due to rolling conditions, and thus prediction accuracy is not high.

SUMMARY OF THE INVENTION

Accordingly, one object of the present invention, which has been designed to solve the above problems, is to provide rolling roll profile control equipment that can reduce and control the effect of thermal crown variation.

Another object of the present invention is to provide rolling roll profile control equipment that can render unnecessary special detectors that detect roll profile.

A further object of the present invention is to provide rolling roll profile control equipment that is able to improve control of roll profile by discriminating and predicting the thermal crown out of the roll profile deformation components.

A yet further object of the present invention is to provide rolling roll profile control equipment that is able to promote improvement of the thermal efficiency of the rolling system and environmental protection.

The above objects of the present invention are achieved by providing rolling roll profile control equipment having the following configuration. That is to say, this is rolling roll profile control equipment that provides:

- a roll profile measurement means that divides the axial direction of the rolling mill roll control unit by control unit, and measures the roll diameter of each divided section;
- temperature management means that are provided at every section into which the roll is divided and respectively include at least one of a cooling means that cools the corresponding section or a heating means that heats the corresponding section; and
- roll profile control means at every section into which the roll is divided that respectively controls the temperature management means so that they follow the desired roll profile values measured by the roll profile measurement means.

Moreover, the above objects of the present invention are achieved by providing rolling roll profile control equipment having the following configuration. That is to say, this is rolling roll profile control equipment that is equipped with a roll profile prediction means that

- calculates the gauge meter strip thickness based on at least the roll gap and rolling load of the rolling mill;
- calculates the strip thickness deviation of the center of the strip by comparing this gauge meter strip thickness with the strip thickness measured value or the strip thickness predicted value based on this strip thickness measured value;
- predicts the roll diameter in the central part of the axial direction of the roll from this strip thickness deviation;and
- predicts the roll diameter of each section into which the roll is divided based on this predicted value of the roll diameter of the central part in the axial direction, and uses this roll profile prediction means in place of the roll profile measurement means.

Furthermore, the above objects of the present invention are achieved by providing rolling roll profile control equipment having the following configuration. That is to say, this is rolling roll profile control equipment in which the roll profile prediction means predicts the roll wear component from of the roll diameters obtained by prediction as increasing in proportion to the rolled length and the rolling load, and predicts the remainder as the amount of thermal crown.

Even further, the above objects of the present invention are achieved by providing rolling roll profile control equipment having the following configuration. That is to say, this is rolling roll profile control equipment in which the roll profile control means cools the roll during rolling and heats the roll during stand-by when not rolling.

Still further, the above objects of the present invention are achieved by providing rolling roll profile control equipment having the following configuration. That is to say, this is rolling roll profile control equipment in which the roll profile control means controls the temperature management means so that the roll diameters of each section into which the roll is divided become constant.

Again, the above objects of the present invention are achieved by providing rolling roll profile control equipment having the following configuration. That is to say, this is rolling roll profile control equipment in which the heating means is provided with any one, or a plurality, of heating elements out of heater heating, hot air blowing, hot water spraying and induction heating.

Yet again, the above objects of the present invention are achieved by providing rolling roll profile control equipment having the following configuration. That is to say, this is rolling roll profile control equipment in which the heating means sprays recycled water after it has cooled the strip.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
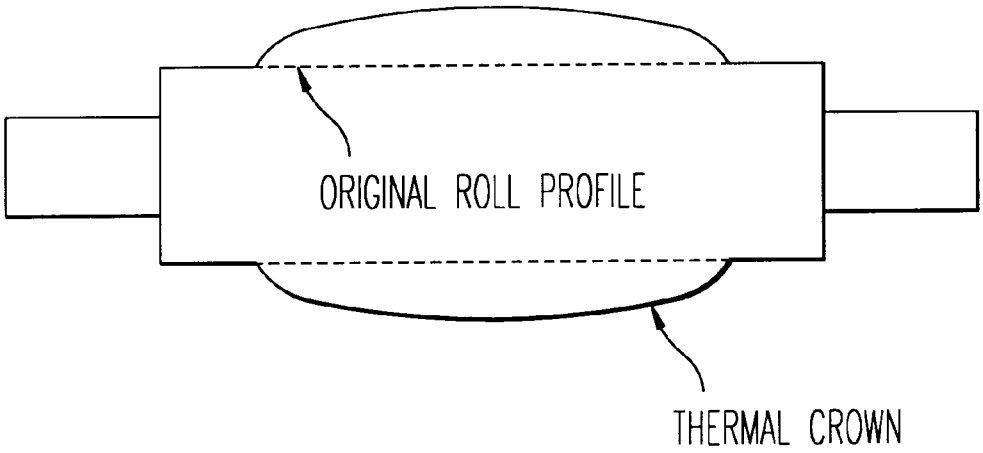
FIG. 1 (*a*) and (*b*) are an illustration showing the relationship between roll thermal crown and roll wear.
Figure 1B:
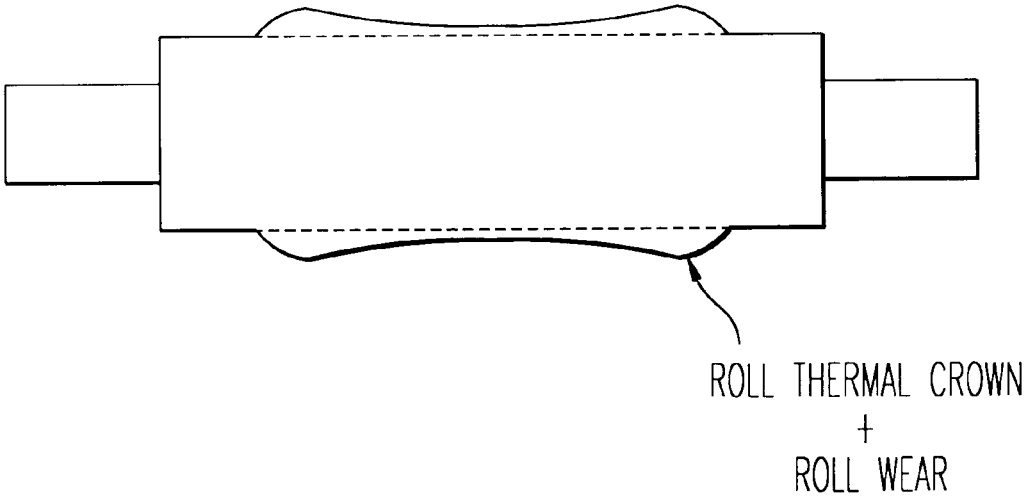
Figure 2A:
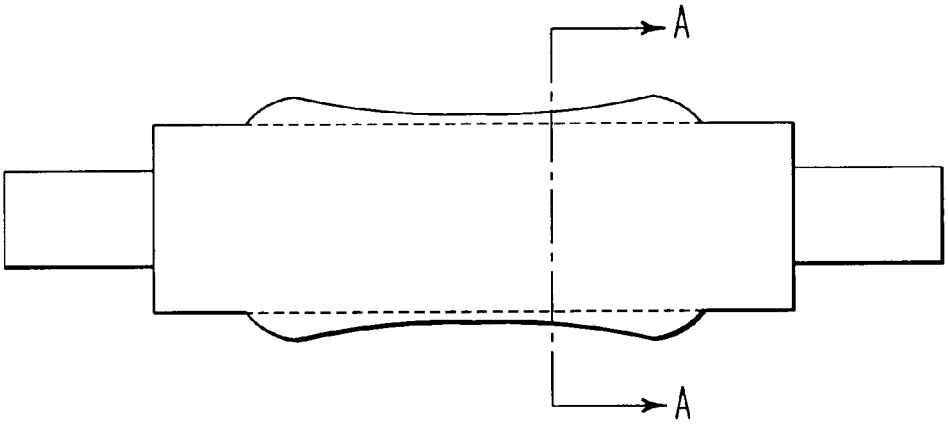
FIG. 2 is a graph showing the relationship between roll thermal crown and roll wear in relation to time.
Figure 2B:
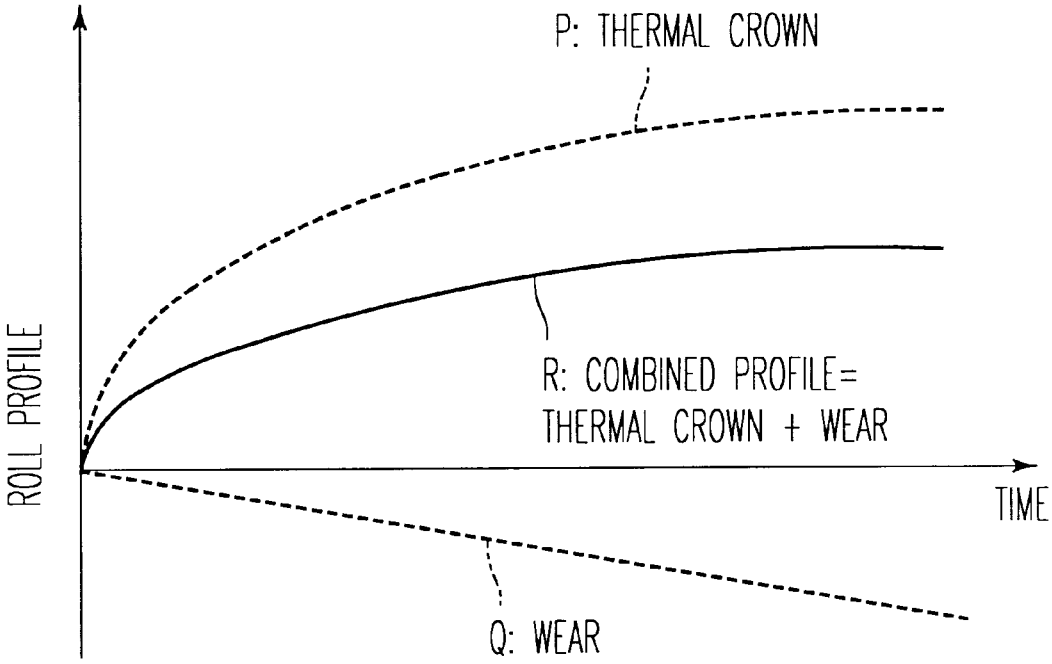

Referring now to the drawings, wherein like reference numerals designate identical or corresponding parts throughout the several views, and more particularly to FIG. 4 thereof, one embodiment of the present invention will be described.

Figure 4:
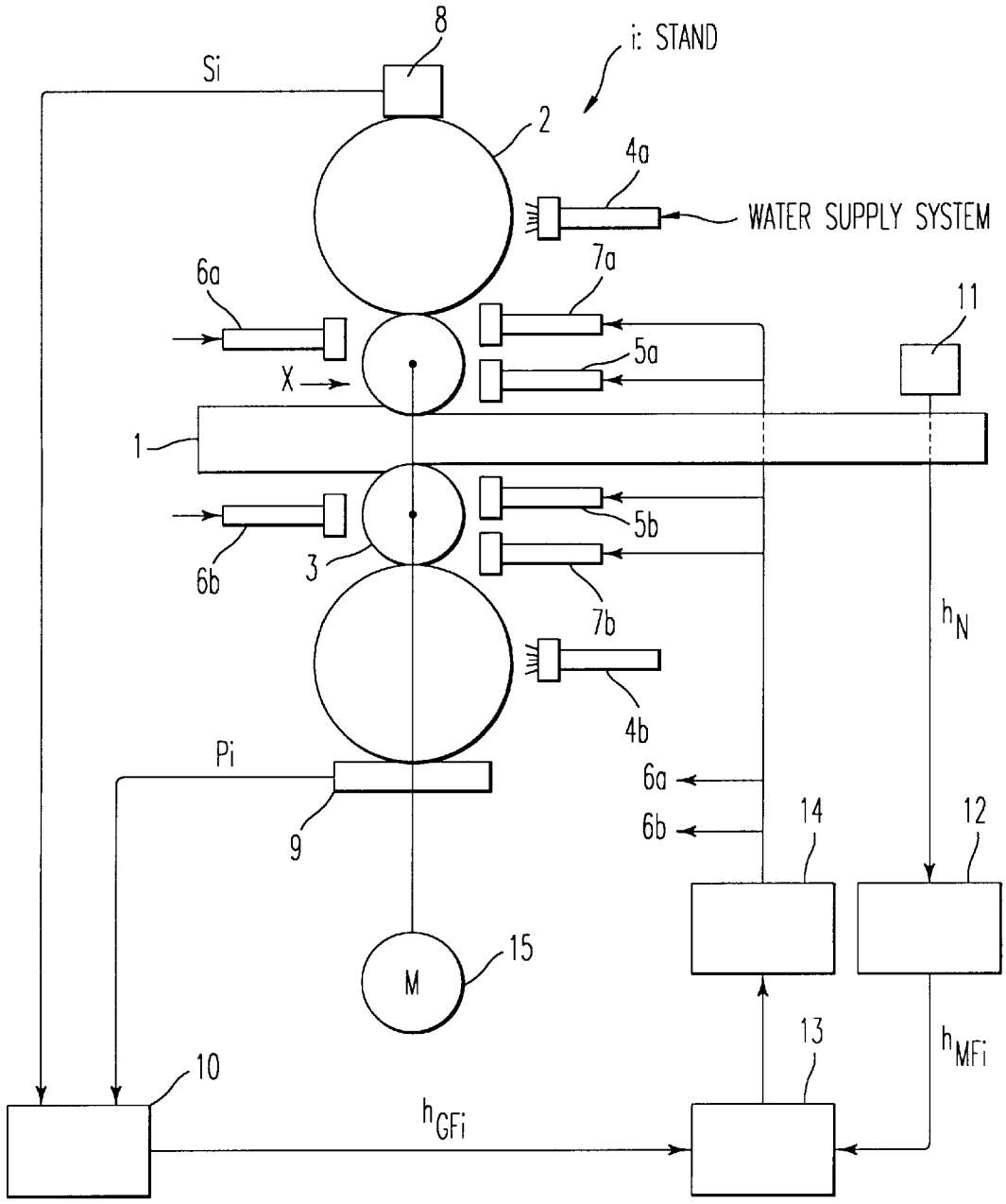
FIG. 4 is an overall block diagram showing a first embodiment of the rolling roll profile control equipment concerned in the present invention, together with a rolling system.

FIG. 4 is an overall block diagram showing a first embodiment of the rolling roll profile control equipment according to the present invention, together with a rolling system. In this drawing, a pair of work rolls 3 are positioned on the inward sides of a pair of back-up rolls 2 to form a commonly-known rolling stand, and strip 1 is rolled by this stand. A roll-driving main motor 15 drives the pair of work rolls 3. Also, the pair of back-up rolls 2 are respectively provided with a back-up roll cooling means 4*a* for cooling the top back-up roll 2, and a back-up roll cooling means 4*b* for cooling the bottom back-up roll 2. These back-up roll cooling means 4*a* and 4*b* can, for example, be configured to conduct strip cooling water via a water supply system (omitted from the drawing) and to spray this water on the back-up rolls 2 from nozzles or the like.

Also, a work roll cooling means 5*a* for cooling the top work roll 3 and a work roll cooling means 5*b* for the cooling bottom work roll 3 are provided on the exit side of strip 1, viewed from the work rolls 3. Moreover, a work roll cooling means 6*a* for the cooling top work roll 3 and a work roll cooling means 6*b* for cooling the bottom work roll 3 are provided on the entry side of strip 1. These work roll cooling means 5*a*, 5*b*, 6*a* and 6*b* are also configured to conduct strip cooling water via water supply systems (omitted from the drawing) and to spray this water on the work rolls 3 from nozzles or the like. However, the work roll cooling means 5*a*, 5*b*, 6*a* and 6*b* are respectively provided with functions for controlling the amount of water.

Furthermore, a work roll heating means 7*a* for heating the top work roll 3 and a work roll heating means 7*b* for heating the bottom work roll 3 are provided on the exit side of strip 1, viewed from work rolls 3. These work roll heating means 7*a* and 7*b* may use any one heating element such as heater heating, hot air blowing, hot water spraying and induction heating. They may also use a plurality of heating elements out of these. However, all of these heating elements possess the function of temperature adjustment by controlling the heating medium.

In the present invention, work roll cooling means 5*a*, 5*b*, 6*a*, and 6*b* and work roll heating means 7*a* and 7*b* will be referred to as "temperature management means".

Figure 5:
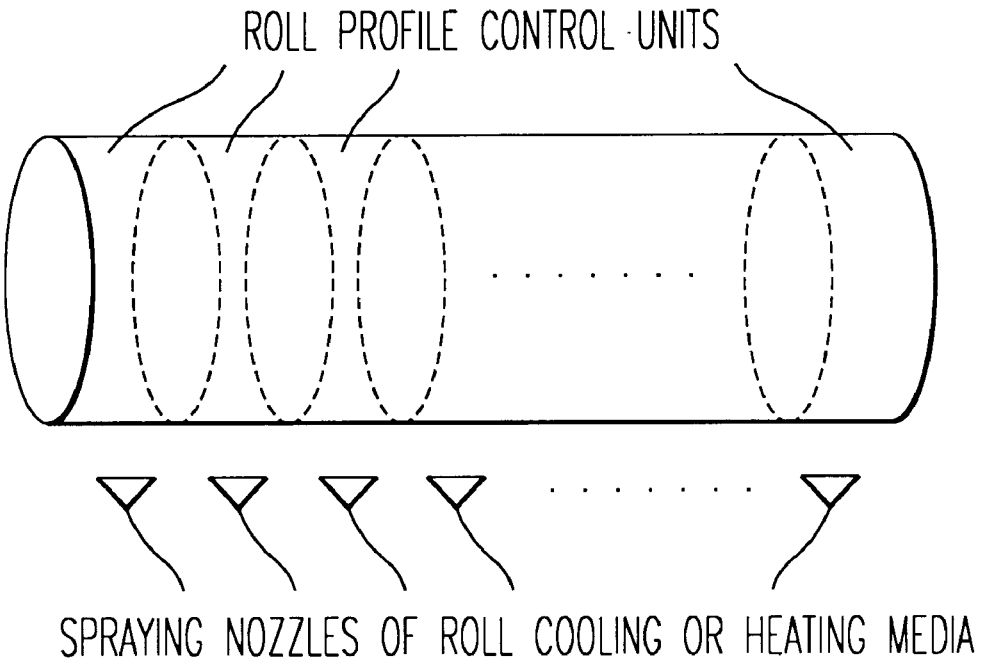
FIG. 5 is a diagram showing the disposition of the main elements that compose the first embodiment shown in FIG. 4.

In this case, as shown in FIG. 5, work roll cooling means 5*a*, 5*b*, 6*a*, and 6*b* and work roll heating means 7*a* and 7*b* are provided for every control unit into which the axial direction of the roll is divided at appropriate intervals.

At the same time, a roll gap detector 8 detects the roll gap between the pair of work rolls 3, and a rolling load detector 9 detects the rolling load. The detected values of these detectors are supplied to a gauge meter strip thickness estimation means 10. The gauge meter strip thickness estimation means 10 estimates the gauge meter strip thickness based mainly on the detected value of the roll gap and the detected value of the rolling load. Also, a strip thickness meter 11 is provided to detect the strip thickness after rolling. A mass flow strip thickness estimation means 12 calculates the mass flow based on that detected strip thickness and calculates the mass flow strip thickness using this mass flow.

The roll profile prediction means 13 compares the gauge meter strip thickness from the gauge meter strip thickness estimation means 10 with the mass flow strip thickness from the mass flow strip thickness estimation means 12 and predicts the roll profiles in the axial directions of work rolls 3. Then, the roll profile control means 14 is configured to control the work roll cooling means 5*a*, 5*b*, 6*a* and 6*b* and the work roll heating means 7*a* and 7*b* so that the desired roll profile will be obtained.

Figure 6:
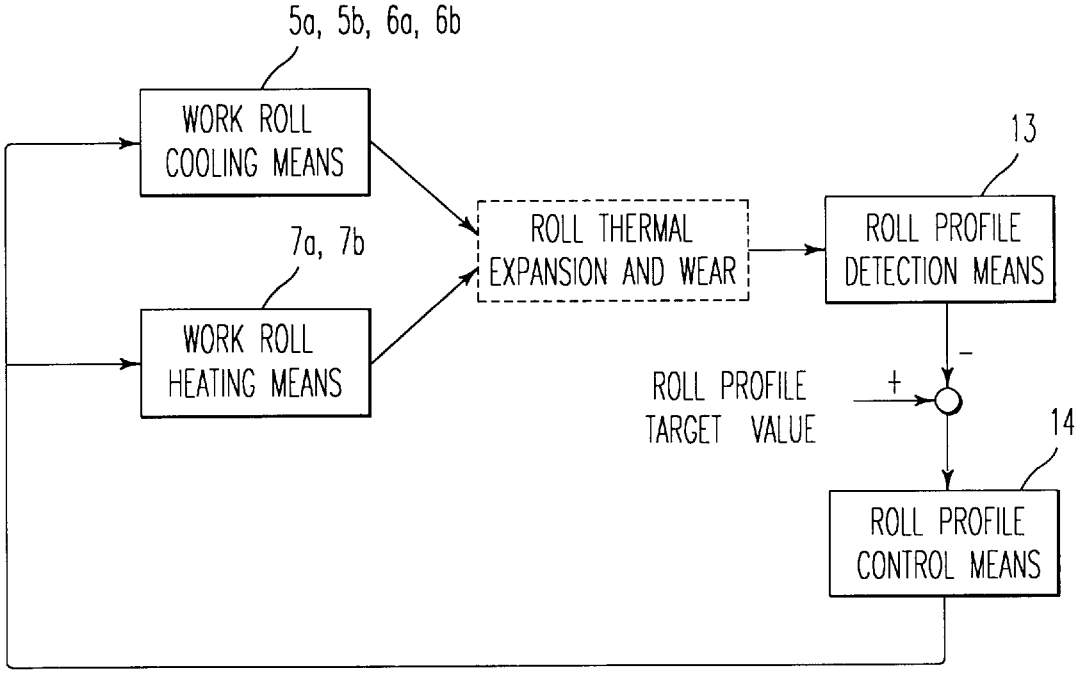
FIG. 6 is a block diagram showing the detailed configuration of the control system that composes the first embodiment shown in FIG. 4.

FIG. 6 is a block diagram showing the control system out of the overall configuration shown in FIG. 4. This is configured as follows. The predicted roll profile according to roll profile prediction means 13 and the roll profile target value (reference value) are supplied to the roll profile control means 14. Then, the roll profile control means 14 controls the combined value of roll thermal crown and wear by controlling the cooling media and heating media of work roll cooling means 5*a*, 5*b*, 6*a* and 6*b* and work roll heating means 7*a* and 7*b* so that the difference between these two roll profiles approaches zero.

Figure 7:
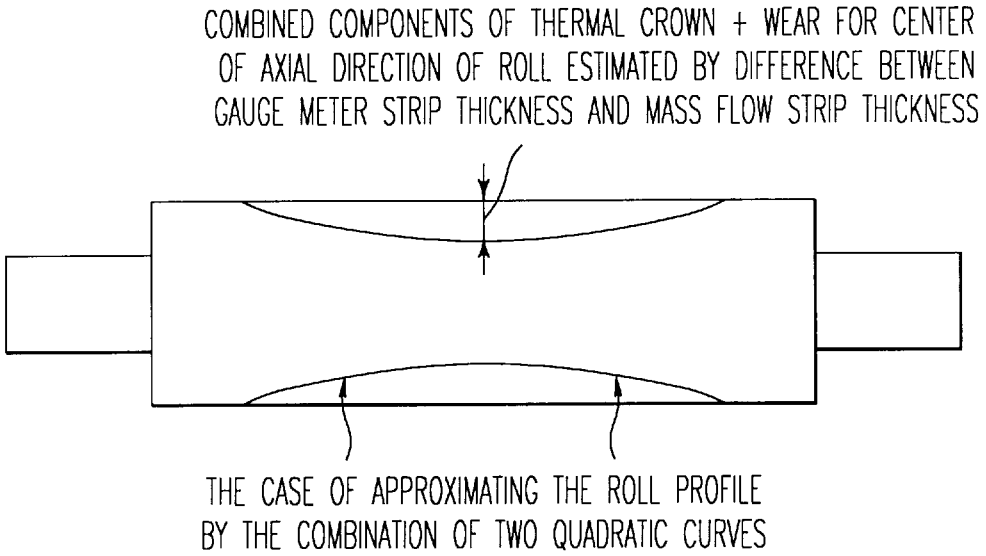
FIG. 7 is an illustration showing an example of a roll profile to illustrate the action of the first embodiment shown in FIG. 4.
Figure 8A:
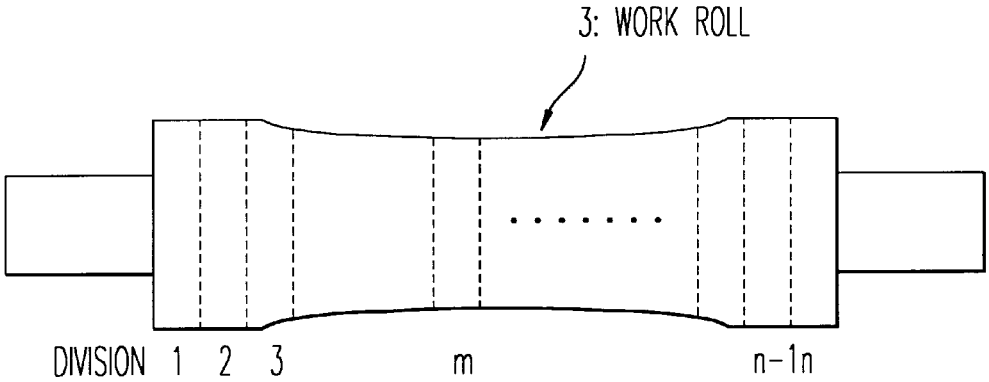
FIGS. 8 (*a*)~(*d*) are time charts showing the heating and cooling states at representative positions in the axial direction of a roll to illustrate the action of the first embodiment shown in FIG. 4.
Figure 8B:
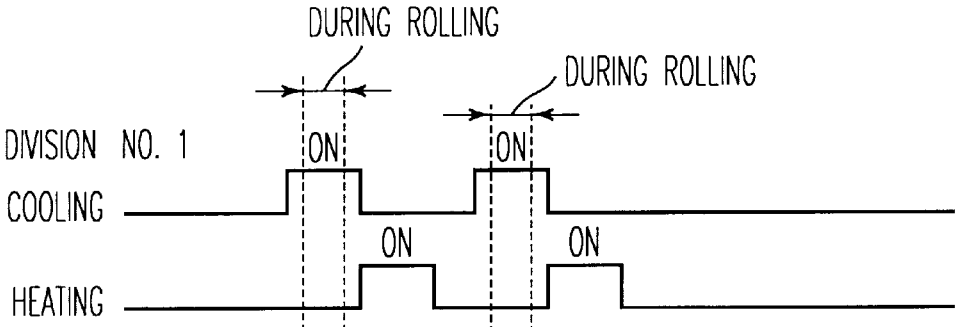
Figure 8C:
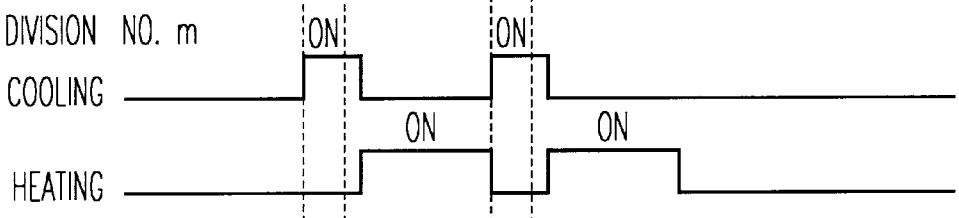
Figure 8D:
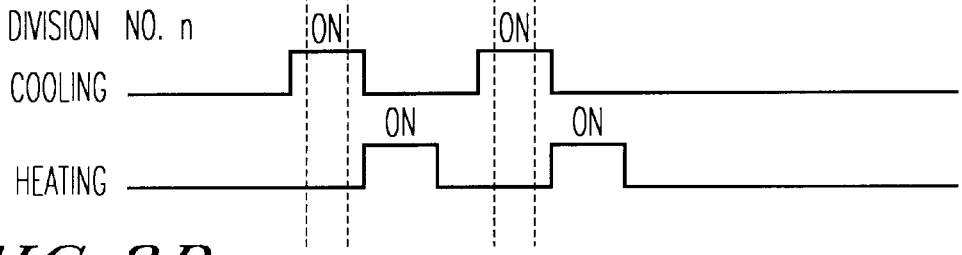

The action of the first embodiment, configured as described above, is described below with reference also to FIG. 7 and FIG. 8.

Firstly, the rolling stand shown here is taken as the ith rolling stand out of 5~7 stands arranged in tandem. Strip 1 is rolled in the X arrow direction by work rolls 3 being driven by roll drive main motor 15. That is to say, it moves in a direction from the left to the right of the drawing. At this time, a roll gap detector 8 detects the roll gap $S_i$ of work rolls 3 and supplies it to the gauge meter strip thickness estimation means 10. Rolling load detector 9 detects rolling load $P_i$ and supplies it to the gauge meter strip thickness estimation means 10. The gauge meter strip thickness estimation means 10 calculates the gauge meter strip thickness $h_{GMi}$ at the center in the strip width direction of the ith stand by the following equation.

$$h_{GMi} = S_i + \frac{P_i}{M_i} \tag{1}$$

Here, $S_i$: Roll gap for i stand $P_i$: Rolling load for i stand $M_i$: i stand rolling mill constant.

Incidentally, with regard to $h_{GMi}$, the gauge meter strip thickness estimation means 10 performs various corrections to the rolling speed, including a correction for the thickness of the oil bearing used. However, basically it performs the estimate using Equation (1).

On the other hand, the strip thickness meter 11 is installed at the exit side of the i stand shown in FIG. 4, or is installed on the exit side of a stand downstream (or upstream) of the i stand. When the strip thickness meter 11 has been installed on the exit side of the i stand, strip thickness $h_x$ detected by strip thickness meter 11 is taken as the i stand mass flow strip thickness $h_{MFi}$ in the center of the strip width direction. The mass flow strip thickness estimation means 12 shown in this embodiment applies to the strip thickness meter 11 installed at the exit stand of the Nth stand other than the i stand, and, using that detected value $h_N$, calculates the mass flow strip thickness $h_{MFi}$ by the following expression (equation), based on the mass flow constant principle.

$$h_{MFi} = \frac{(1 + f_N) \cdot VR_N \cdot h_N}{(1 + f_i) \cdot VR_i} \tag{2}$$

Here, $h_N$: Strip thickness detected by strip thickness meter provided on exit side of N stand $f_N$: N stand forward slip ratio $f_i$: i stand forward slip ratio $V_N$: Roll peripheral speed of N stand work rolls $V_i$: Roll peripheral speed of i stand work rolls.

If the above gauge meter strip thickness $h_{GMi}$ is taken as not considering models equivalent to thermal crown and roll wear, but is taken as fully considering models other than these, the effects of thermal crown and wear will appear in mass flow strip thickness $h_{MFi}$. Thus, if mass flow strip thickness $h_{MFi}$ based on actual measurement values is taken as becoming a positive value, strip thickness deviation component $\Delta h_{RP}$, based on the combined values of thermal crown and wear can be found by the following expression (equation).

$$\Delta h_{RP}=h_{GMi}-h_{MFi} \quad (3)$$

Here, the case can be inferred that, when $\Delta h_{RP}<0$, thermal crown is greater than wear, and when $\Delta h_{RP}<0$, thermal crown is smaller than wear.

Also, when it is required to separate the thermal crown and the wear component, the wear component is calculated in advance by the following expression (equation).

$$\text{Roll wear component}=K\cdot\Sigma(P_S\cdot L_S) \quad (4)$$

Here,

K: Gain $P_S$: Mean value of rolling load sampled at L points during the rolling of 1 strip $L_S$: Length of 1 strip, and Σ( ) indicates the total of the terms in ( ).

Consequently, the remainder when the wear component found by Equation (4) is subtracted from strip thickness deviation component $\Delta h_{RP}$ found by Equation (3) corresponds to the thermal crown.

On the other hand, the roll profile is the roll diameter distribution in the axial direction of the roll. Thus it is difficult to grasp the overall roll profile using only the strip thickness deviation component $\Delta h_{RP}$ of Equation (3), which relates to the roll diameter of the roll in the center of the axial direction. For that reason, various methods of calculating roll profile other than at the center have been proposed, and the roll profile can be found by using any one of those methods. However, in order to finely divide the roll into a mesh in the axial direction, calculate the boundary conditions for each single mesh, and calculate the temperature for each mesh, the computer program will be complex and the load on the computer will be very great. Therefore, as shown in FIG. 7, the roll profile in the axial direction of the roll can be calculated by taking the thermal crown corresponding to strip thickness deviation $\Delta h_{RP}$, of the roll center found by Equation (3) as the basis, and by using quadratic curves, cubic curves, exponential functions and the like.

The roll profile prediction means 13 executes the calculation of Equation (3) and Equation (4). Moreover, it finds the thermal crown and then, using quadratic curves, cubic curves, exponential functions and the like, calculates the roll diameters at every control unit in the axial direction of the roll and supplies those to roll profile control means 14. The roll profile control means 14 controls the work roll cooling means 5*a*, 5*b*, 6*a* and 6*b* and work roll heating means 7*a* and 7*b* so that the roll diameters predicted by roll profile prediction means 13 follow the roll profile target values. That control will be explained in further detail with reference to FIG. 8 and FIG. 3.

Figure 3A:
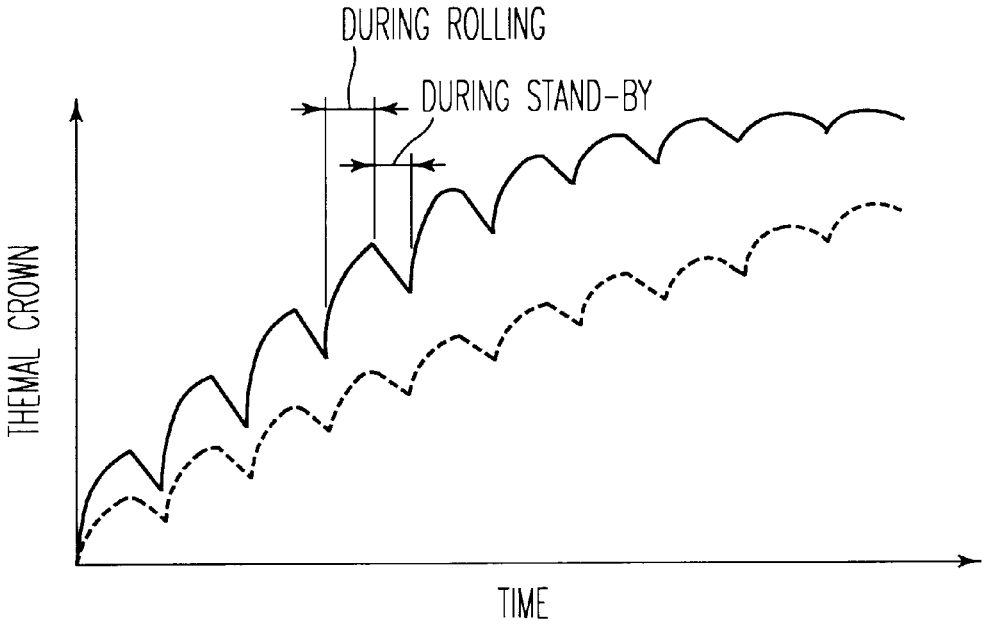
FIGS. 3 (*a*) and (*b*) are graphs for two different rolling pitches showing the course of growth of thermal crown and wear in relation to time in the process of rolling a series of strips.
Figure 3B:
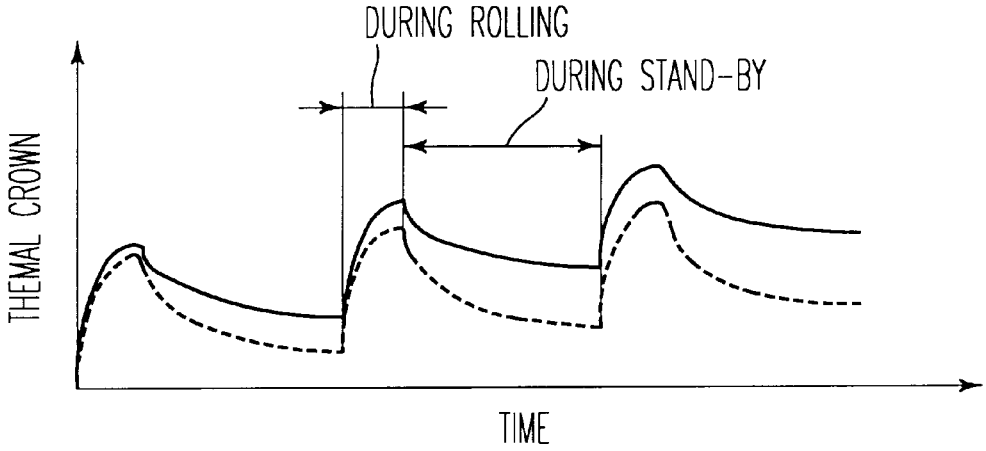

The dotted line shown in FIG. 3 (*a*) is the state of growth of the roll thermal crown when only roll cooling is performed. This thermal crown goes on growing with the passage of time during rolling. However, when it is cooled, even during stand-by when rolling is not being performed, the thermal crown is slower to reach the saturation domain. With the thermal crown in the unsaturated state, even during the rolling of one strip, there will be disturbances in control of the amount of the set roll gap, the crown and flatness. Also, even taking the continuous rolling of a plurality of strips under the same conditions, there will be disturbances such that the settings must be changed for each strip.

On the other hand, as shown by the solid line in FIG. 3 (*a*), if it is possible to quickly achieve and hold the thermal crown in the saturation domain, it is possible to reduce the effect of disturbances due to variation of the thermal crown. This solid line shown in FIG. 3 (*a*) is one in which there was cooling during rolling and heating during stand-by.

Also, as shown in FIG. 3 (*b*), when the time between one rolling and the next rolling is long, the thermal crown does not saturate. Of these lines, the dotted line is the case when there is cooling only. The solid line is the case of cooling the roll during rolling and heating during part of the stand-by time. By so doing, it is possible to promote thermal crown growth, cause rapid achievement of the saturation domain, and reduce variations of the thermal crown.

Therefore, the roll profile control means 14 controls the work roll cooling means 5*a*, 5*b*, 6*a*, and 6*b* and work roll heating means 7*a* and 7*b* so that they heat during stand-by and cool during rolling, as shown in FIG. 3 (*a*) and (*b*). By this means, it can cause rapid growth of the thermal crown, and thus can control disturbances in strip thickness control and crown and flatness control.

Also, the roll profile control means 14 executes control which alters the cooling and heating times of the work roll cooling means 5*a*, 5*b*, 6*a*, and 6*b* and the work roll heating means 7*a* and 7*b*, which are positioned at every control unit in the axial direction of work roll 3. That is to say, as shown in FIG. 8 (*a*), the work roll 3 is divided into n sections in the axial direction and, taking each section as a profile control unit, the work roll cooling means 5*a*, 5*b*, 6*a*, and 6*b* and work roll heating means 7*a* and 7*b* are provided as shown in FIG. 5.

In this case, the wear is great at the center of work roll 3 because of the frequency of contact with the strips, while the wear is small at the two ends since there are fewer occasions of contact with the strips. Thus, a flat profile can be maintained over the whole axial direction by making the cooling time long while making the heating time short at the ends of work roll 3 in the axial direction, and making the cooling time short while making the heating time long in the center of the axial direction.

FIG. 8 (*b*) shows the relationship between cooling time and heating time at section No. 1 of the control units into which the roll is divided. FIG. 8 (*c*) shows the relationship between cooling time and heating time at section No. m in the center of the axial direction. FIG. 8 (*d*) shows the relationship between cooling time and heating time at section No. n.

In all of these sections, there is cooling during rolling and heating during stand-by. However, in No. m section in the center of the axial direction, the cooling time is shorter during rolling and the heating time is longer during stand-by than in end sections No. 1 and No. n. FIG. 8 (*b*), (*c*) and (*d*) show representative sections in the axial direction. In the sections intermediate to these, taking the roll profile into consideration, the cooling and heating times may be varied more and more. By this means, it is possible to maintain the roll profile constant over the entire axial direction of work roll 3.

Incidentally, this embodiment has assumed cooling during rolling and heating during stand-by. However, there are, for example, cases in which, at the stage when the thermal crown has reached the saturation domain, parts of the roll profile target values that are larger and smaller than the predicted values of roll diameters exist. In such cases, it may be decided to cool, or to heat, every roll diameter control unit, regardless of whether it is during rolling or not.

Accordingly, the deviation HC of roll profile is found by the calculation in following equation.

$$HC=RP_{REF}-RP_{EST} \quad (5)$$

Here, $RP_{REF}$: Roll profile target value $RP_{EST}$: Roll profile predicted value.

Also, if HC>0, there is heating, and if HC<0, there is cooling. By this means, it is possible to continue to maintain the roll diameters constant over the entire axial direction.

However, in the above embodiment, any one heating element, or a plurality of heating elements, such as heater heating, hot air blowing, hot water spraying, and induction heating may be used as work roll heating means 7*a* and 7*b*. However, the use of hot water alone as the heating medium has the following advantages.

Generally, the temperature of the work roll 3 is about 60° C. in hot rolling. In the case of using hot water, it is possible to use a configuration that recovers the water that has cooled the strip and sprays this water directly on the roll after filtration. In this case, it is possible to reuse the heat contained in the water having cooled strip 1, and thus to improve thermal efficiency and preserve the environment.

Figure 9:
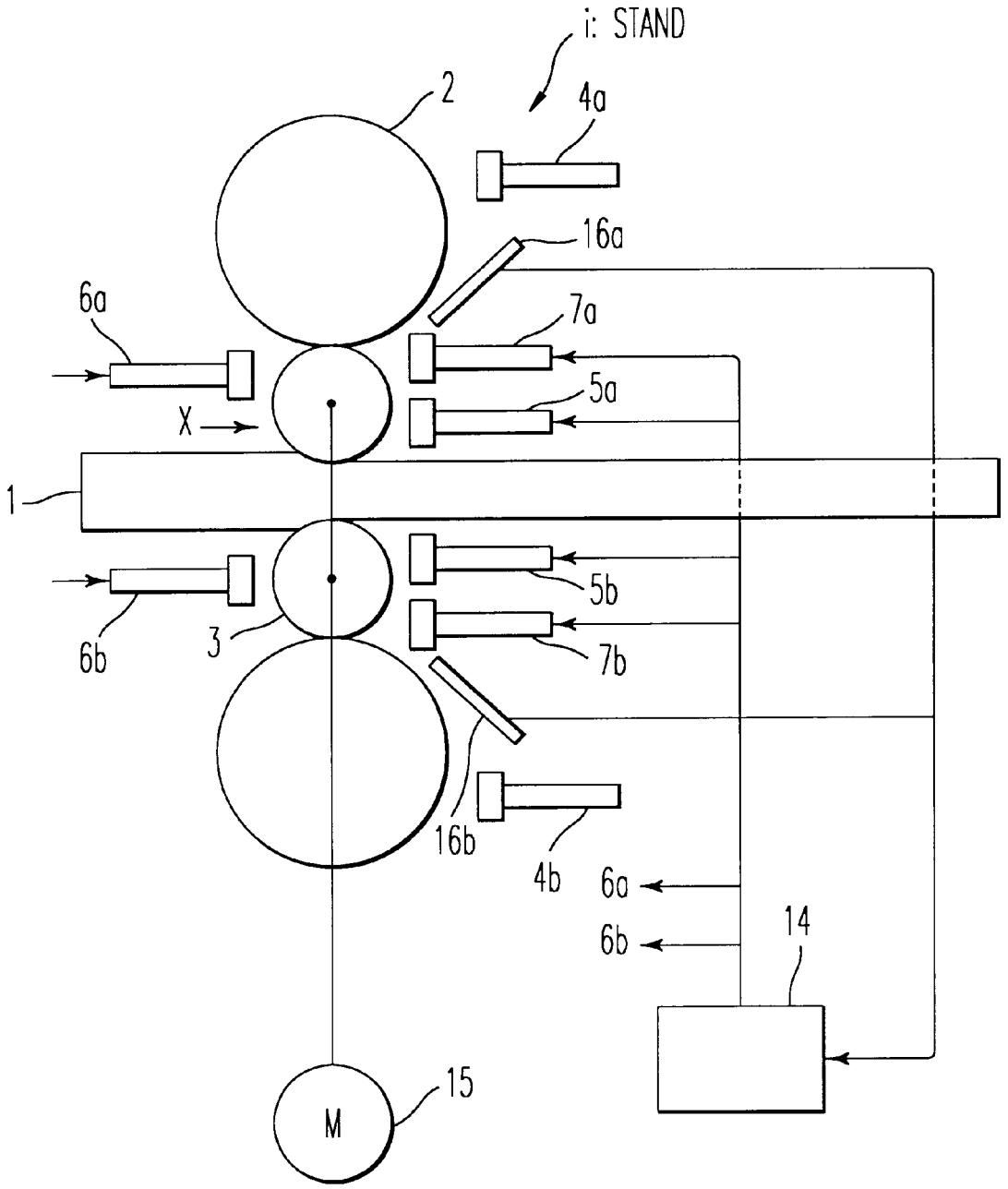
FIG. 9 is an overall block diagram showing a second embodiment of the rolling roll profile control equipment concerned in the present invention, together with a rolling system.

FIG. 9 is an overall block diagram showing a second embodiment of the rolling roll profile control equipment according to the present invention, combined with a rolling system. In the drawing, parts that are identical to those in FIG. 4 showing the first embodiment are designated by like reference numerals, and their descriptions have been omitted. The first embodiment, shown in FIG. 4, considered direct detection of the roll profile to be comparatively difficult, and predicted the roll profile by comparing gauge meter strip thickness $h_{GMi}$ and mass flow strip thickness $h_{MFi}$ at the i stand. However, methods of measuring the roll profile optically or by contact can be considered. FIG. 9 is in line with this concept and shows equipment designed for direct detection by the roll profile detection means 16*a* and 16*b*. Those detected values are supplied to the roll profile control means 14.

Figure 10:
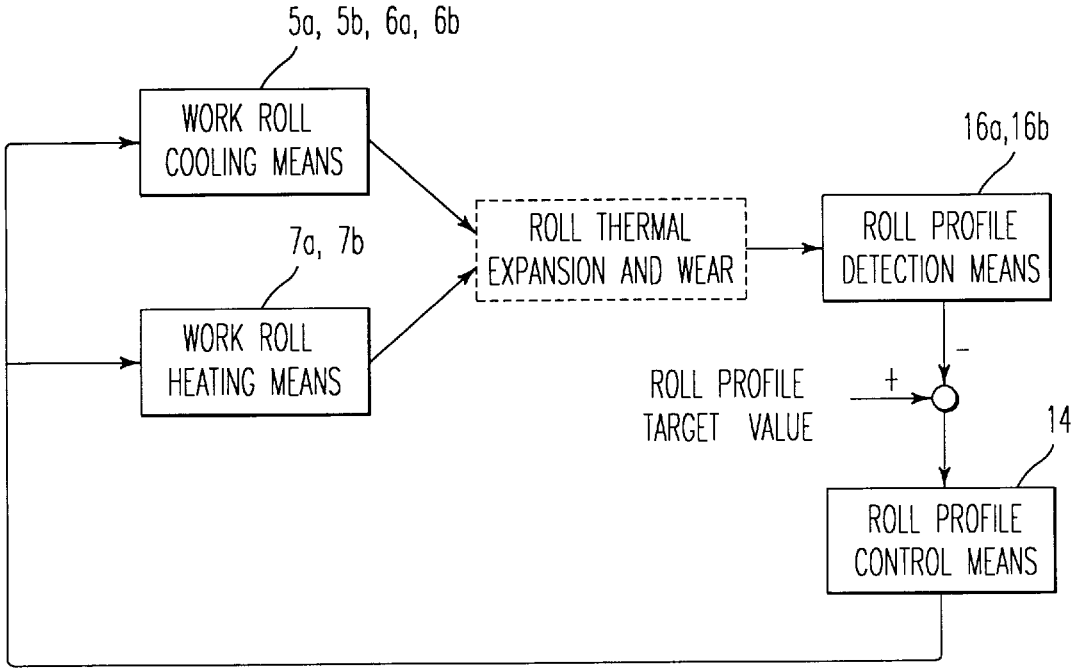
FIG. 10 is a block diagram showing the detailed configuration of the control system that composes the second embodiment shown in FIG. 9.

FIG. 10 is a block diagram showing the control system out of the overall configuration shown in FIG. 9. The configuration is as follows. The roll profile detects values from the roll profile detection means 16*a* and 16*b* and the roll profile target values are supplied to the roll profile control means 14. The roll profile control means 14 controls the combined value of roll thermal crown and wear by controlling the cooling media and heating media of work roll cooling means 5*a* and 5*b* and the work roll heating means 7*a* and 7*b* so that difference between the detected and target values approaches zero.

The detailed action of roll profile control means 14 is the same as that described using FIG. 4 and therefore a description has been omitted here.

Thus, when using the second embodiment, control is exercised so that the roll profile measured values follow the target values. Therefore, the accuracy of roll profile control can be improved.

Incidentally, according to the above embodiments, work roll cooling means 7*a* and 7*b* are provided on the strip entry side and work roll cooling means 6*a* and 6*b* are provided on the strip exit side of work roll 3, respectively. However, when the cooling performance is high, these means may be provided on the strip entry side only, or they may be provided on the strip exit side only.

As will be clear from the above description, when using the present invention, when controlling the roll diameter in the axial direction of a rolling mill roll, roll diameters are measured for each section into which the axial direction of the roll is divided control unit by control unit, and temperature management means that are included in at least one of the cooling means and heating means provided in each divided section are controlled so that the measured roll diameters follow the desired values. Therefore, compared with prior art equipment that used only cooling means, the effect of variations in the thermal crown can be further reduced.

Also, when using the present invention, the roll diameter in the center of the roll axial direction is predicted by comparing the gauge meter strip thickness with the strip thickness measured value or the strip thickness predicted value based on this strip thickness measured value. Moreover, the roll diameters for each section into which the roll is divided are predicted based on this predicted value. Therefore, the effect that a special detector that detects roll profile is rendered unnecessary is also obtained.

Moreover, when using the present invention, for the roll wear component, the amount of wear is predicted as increasing in proportion to rolled length and rolling load, while the remainder is predicted as the amount of thermal crown. Therefore, there is the advantage that control of roll profile is simplified.

Furthermore, when using the present invention, the roll profile control means cools the roll during rolling and heats the roll during stand-by when not rolling. Therefore, as well as speeding-up thermal crown growth, rolling is performed in a domain that is close to the saturation domain. Consequently, the effect is obtained that the influence of thermal crown variations is still further reduced.

Still further, when using the present invention, at least one of the cooling media and heating media is controlled so that the roll profile in each divided section of the roll becomes constant. Therefore, in comparison with prior art equipment that used only cooling means, the effect of variations of the thermal crown can be even further reduced.

Again, when using the present invention, one or a plurality of heating elements for heater heating, hot air blowing, hot water spraying, or induction heating is provided as the heating means. Therefore, there is also the effect that a convenient means can be selected and used.

Yet again, when using the present invention, the heating means sprays water recycled after cooling the strip. Therefore, the effects of improvement of the thermal efficiency of the rolling system and promotion of preservation of the environment can also be obtained.

Obviously, numerous additional modifications and variations of the present invention are possible in light of the above teachings. It is therefore to be understood that within the scope of the appended claims, the present invention may be practised otherwise than as specially described herein.

What is claimed is:

1. Rolling roll profile control equipment, comprising:

roll profile measurement means for dividing an axial direction of a roll of a rolling mill into control units and for measuring the roll diameter of each of control units;

temperature management means at each control unit and including a cooling means for cooling the corresponding control unit and a heating means for heating the corresponding control unit; and roll profile control means for controlling said temperature management means so that each roll diameters measured by said roll profile measurement means follows a desired value.

2. Rolling roll profile control equipment according to claim 1, wherein said roll profile control means:

calculates gauge meter strip thickness based on at least a roll gap and a rolling load of said rolling mill;

calculates a strip thickness deviation of the center of a strip by comparing said gauge meter strip thickness with a strip thickness measured value or a strip thickness predicted value based on said strip thickness measured value;

predicts said roll diameter in the central part of said axial direction of said roll from said strip thickness deviation; and predicts said roll diameter of each divided section of said roll based on said predicted value of said roll diameter of the central part in said axial direction.

3. Rolling roll profile control equipment according to claim 2, wherein:

said roll profile control means, for a roll wear component, from said roll diameters obtained by prediction, predicts said roll wear as increasing in proportion to a rolling length and a rolling load, and predicts the remainder as the amount of thermal crown.

4. Rolling roll profile control equipment according to claim 1, 2, or 3, wherein:

said roll profile control means cools said roll during rolling and heats said roll during stand-by when not rolling.

5. Rolling roll profile control equipment according to any of claim 1, 2 or 3, wherein:

said roll profile control means controls said temperature management means so that said roll diameters of each control unit into which said roll is divided become constant.

6. Rolling roll profile control equipment according to any of claim 1, 2, or 3, wherein:

said heating means comprises heater heating, hot air blowing, hot water spraying, or induction heating.

7. Rolling roll profile control equipment according to any of claim 1, 2, or 3, wherein:

said heating means sprays recycled, hot water after said water has cooled said strip.

* * * * *